US006121527A

United States Patent [19]

Hamm

[11] Patent Number: 6,121,527

[45] Date of Patent: Sep. 19, 2000

[54] MULTIPLE-PIECE MUSICAL INSTRUMENT STAND

[76] Inventor: Kirk W. Hamm, 820 Sycamore Ave., Apt. #206, Vista, Calif. 92083

[21] Appl. No.: 09/353,170

[22] Filed: Jul. 14, 1999

Related U.S. Application Data

[63] Continuation-in-part of application No. 09/106,735, Jun. 29, 1998, abandoned.

[51] Int. Cl.[7] ..... G10G 3/00

[52] U.S. Cl. ..... 84/327; 84/421; 84/453

[58] Field of Search ..... 84/327, 421, 453

[56] References Cited

U.S. PATENT DOCUMENTS

| | | | |
|---|---|---|---|
| 1,612,148 | 12/1926 | Oettinger | 211/85.6 |
| 3,958,786 | 5/1976 | Mann | 248/176.3 |
| 5,372,346 | 12/1994 | Upchurch et al. | 248/304 |
| 5,622,344 | 4/1997 | Gracie | 248/171 |
| 5,664,758 | 9/1997 | Smith | 248/688 |
| 5,852,250 | 12/1998 | Cha | 84/327 |

*Primary Examiner*—Paul Ip
*Assistant Examiner*—Shih-yung Hsieh
*Attorney, Agent, or Firm*—John J. Murphey

[57] ABSTRACT

A multiple-piece musical instrument stand comprising a base including first and second legs extending outward at an acute angle from interconnection therebetween, the legs adapted to rest fully on a planar surface, a first stem of terminal length having one end adapted for inter-fitting with the interconnection of the legs and extending upward therefrom at an acute angle to the plain of the base, a second stem defined by a connecting end for connection to the distal end of the first stem and continuing upward at the same acute angle as the first stem and an instrument yoke extending outward from the second stem member attached thereto adapted to temporarily receive therein the head member of a stringed instrument so as to retain the instrument therein with the weight of the instrument hanging freely downward and above the base to support the instrument within the acute angle formed between the yoke and the base.

17 Claims, 5 Drawing Sheets

MULTIPLE-PIECE MUSICAL INSTRUMENT STAND

RELATION TO OTHER PATENT APPLICATIONS

This application is a Continuation-in-Part of my previous patent application titled FREE STANDING DEVICE FOR HANGING NECKED MUSICAL INSTRUMENTS, filed Jun. 29, 1998 and given Ser. No. 09/106,735, now abandoned.

BACKGROUND OF THE INVENTION

1. Field of the Invention

This invention pertains to the field of music. More particularly, the invention pertains to the employment of musical instruments and to a novel stand to hold a musical instrument in a position for later use during a performance.

2. Description of the Prior Art

In the playing of musical instruments, whether in a band, an orchestra, or a "combo", the fact that one musician may play more than one instrument during the performance requires him or her to temporarily set one or more instruments aside while playing another. While one may merely lay a musical instrument on the floor beside his or her feet as one way of doing it, the better and more accepted procedure is to employ a stand on which to temporarily store the instrument or instruments. There are some stands commercially available for this purpose.

When dealing with certain instruments, such as stringed instruments like a guitar or violin, care must be taken not to place the instrument in such a position where the neck of the instrument will become warped. The strings on guitars and violins are tightly drawn along the neck, between the body and the tuning peg board. This places the slender neck of the instrument under compression and, because all the strings are located on one side of the neck, also places a substantial bending moment about the neck tending to warp the neck in a "C" shape. Should the temporarily storage of the instrument include support for the body and the tuning peg board, the loss of weight of the body allows the strings to place even more stress on the neck and cause warping of the neck and loss of tuning in the instrument.

Further, many commercially available musical instrument stands are rather complex and cumbersome. The complexity requires the use of tools and other instruments to set up the stand thus requiring the musician to haul the tools about along with his or her instruments. Extra tools means extra bulk and weight making one's movement from performance to performance more time-consuming and frustrating. Losing a tool needed to assemble the stand means that the stand may not be assemblable so that it becomes useless as an aid to the musician.

As the complexity of the stand increases, more attention must be turned to setting up the stand and taking it down. With the tasks of a musician being what they are, working in a noisy, smoke-filled rooms, usually full of rude persons, beer drinkers and the like, the musician gets very tired at the end of his or her performance and is in no condition to dismantle a complex piece of machinery that must be packed away in its own special crate and hauled to the next location.

For instance, in U.S. Pat. No. 3,958,786, there is shown a very complex musical stand that has numerous parts requiring adjusting and, after set-up, holds the instrument at an angle both at the bottom of the body and by the tuning peg board. Thus the instrument is supported in a way that encourages warping of the neck and places the instrument at an angle that requires careful lifting for later use. U.S. Pat. No. 4,691,610 shows a guitar stand having a plurality of parts that are assembled with pins, bolts, thumb screws and other small parts that are easily dropped on a stage to roll over to a hole in the floor and drop through thus placing the part out of reach and use by the owner of the stand. U.S. Pat. No. 5,029,796 discloses a musical instrument stand having widely spaced legs that are not foldable so that the entire stand must be carried separate and apart from the musical instrument thus adding a burden to the musician. U.S. Pat. No. 5,313,866 discloses a music stand that can only be used along with a large amplifier of a certain size and shape on which the stand is mechanically bolted. Such a device finds limited use in certain areas but no use where large amplifiers are not used. U.S. Pat. No. 5,375,497 shows a bulky musical instrument stand where the guitar or other instrument is supported both from the top and from the bottom and promotes the warping of the neck of the instrument as previously mentioned. U.S. Pat. No. 5,664,756 discloses an adjustable article stand where a guitar is supported both at the tuning peg board and the body to, again, encourage warping of the neck. The unit is bulky and, even though foldable, requires substantial adjustment before use. Finally, U.S. Pat. No. 5,852,250 discloses a foldable instrument stand that, while hanging the instrument from the top thereof, is rather long and must be carried in one piece, possibly in a trunk or other long carrier. Accordingly, there remains a need for a portable music stand that provides for hanging of a musical instrument therein and that may be dismantled into small enough pieces that they can be carried in a music case, possibly along with the instrument, and that requires no particular tools for setting up or taking down.

SUMMARY OF THE INVENTION

This invention is a multiple-piece musical instrument stand comprising a base including first and second hollow legs extending outward at an acute angle from interconnection therebetween, the legs having at least one flat surface adapted to rest fully on a planar surface, a first short stem of terminal length having one end adapted for inter-fitting with the interconnection of the legs and extending upward therefrom at an acute angle to the plane of the base, a second short stem defined by a connecting end for removably connecting in axial alignment to the distal end of the first stem and continuing upward at the same acute angle as the first stem and, an instrument yoke extending outward from the second stem member attached thereto adapted to temporarily receive therein the top member of an instrument, such as the tuning peg board, so as to retain the instrument therein with the weight of the instrument hanging freely downward, without further support, and above the base to support the instrument within the acute angle formed between the stems and the base.

The invention is dismantelable into a plurality of small parts that may be easily placed in a music case to be transported along with the instrument. The stand is made of hollow metal pipe and is strong yet lightweight. It is assemblable and disassemblable without the need of special tools or other fittings. It comes in four (4) major parts that may be interconnected by a mere twist of the hand.

Accordingly, the main object of this invention is a lightweight, easy to assemble and disassemble music stand that holds a guitar or other stringed instrument only by its upper end so that the overall weight of the instrument helps maintain the slender neck of the instrument in a straight and non-warped condition. Other objects of this invention include a music stand that may be assembled and disassembled by a mere twist of a stem in a fitting so that the legs, stems and instrument carrying hanger are all assembled in one motion and without the need of extraneous tools or other fittings; a music stand that breaks down into short, light-weight parts that can be carried in one or at least a few instrument carrying cases without adding significant weight to the overall entourage of the musician; a device that is rugged in design, uses high-impact plastics as connectors, and that contains a tilt to the yoke so that the instrument is hung freely and without any bottom support that would otherwise promote warping in the neck of the instrument.

The invention is able to hold all makes and models of guitars, including the "flying-V" design, the "lightening bolt" design and others. One does not need to unplug the guitar when it is being held on the stand. The strap that one uses to support the guitar about one's shoulders is not affected by this stand and the strap will not get caught or tangled in the stand.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE PREFERRED EMBODIMENT

Figure 1:
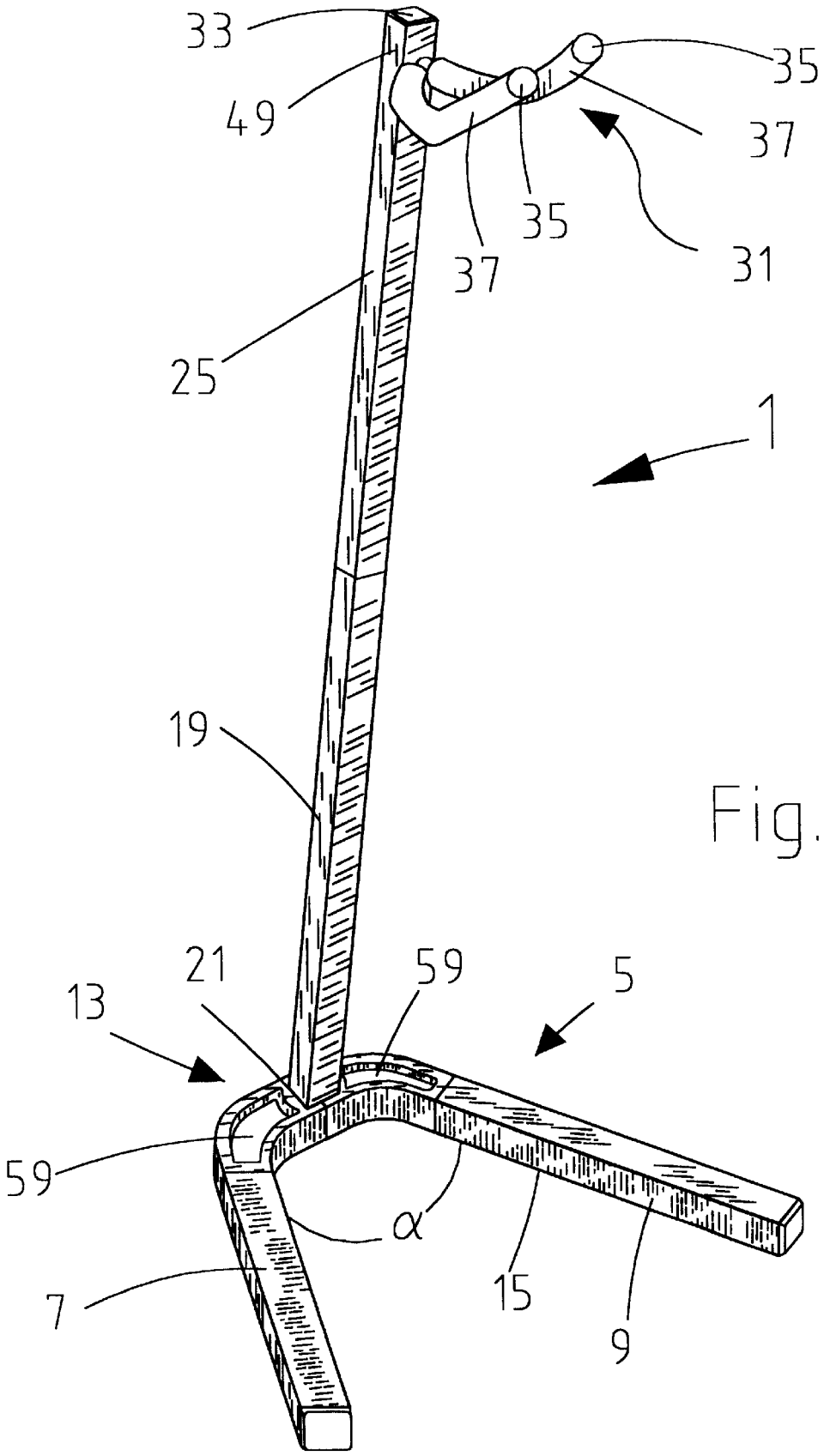
FIG. 1 is an isometric view of the preferred embodiment of this invention.
Figure 2:
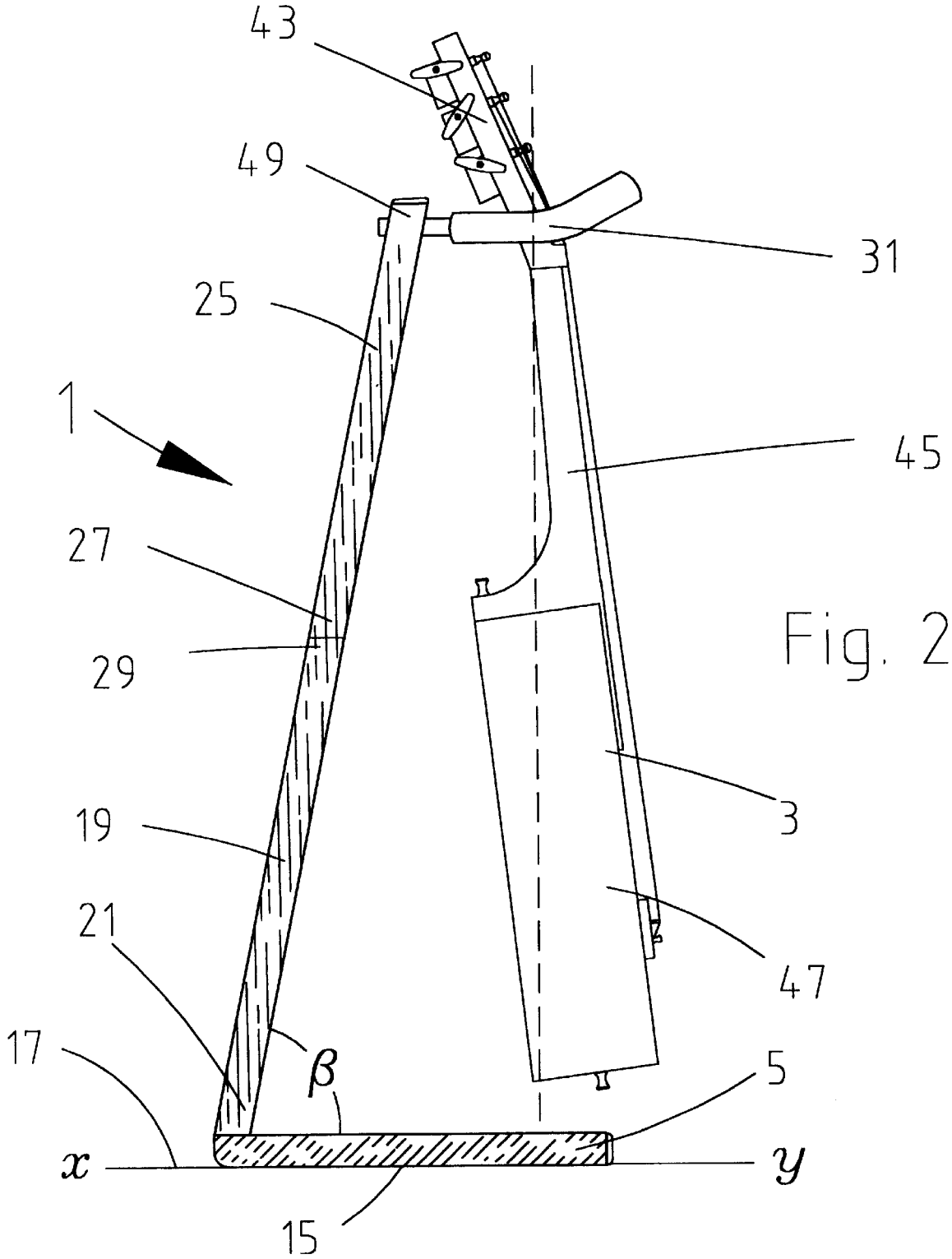
FIG. 2 is a side view of the embodiment shown in FIG. 1.

Turning now to the drawings wherein elements are identified by numbers and like elements are identified by like numbers throughout the eleven figures, the inventive music stand 1 is shown in FIG. 1 standing alone and in FIG. 2 supporting a guitar 3 in operable configuration. Invention 1 is a multiple-piece musical instrument stand generally comprising a base 5 made from and including first and second rather short, straight lengths of metal legs 7 and 9, each leg extending outward at an acute angle "α" from the other, such as 45°, from interconnection 13 therebetween. Legs 7 and 9 each have at least one flat surface 15 adapted to rest fully on a planar surface such as a floor 17, stage or the like. A first short stem 19 of terminal length is provided having one end 21 adapted for inter-fitting with interconnection 13, between legs 7 and 9, and extending upward therefrom at an acute angle "β" to the plane "x-y" of base 5.

A second short stem 25, is provided, defined by a connectable end 27, for removably connecting to the distal end 29 of first stem 19, and continuing upward at the same acute angle "β" as first stem 19. Legs 7 and 9, as well as first stem 19 and second stem 25 are preferably made from hollow metal stock and more preferably made from square hollow metal stock. Such material is economical, easy to fabricate into the parts necessary for this invention, is light-weight so that the disassembled stand may be easily transported from place to place, and is readily grasped by hand to assemble and twist as is required in one connection.

An instrument yoke 31 is shown in FIGS. 1, 2, 3 and 4 extending outward from second stem 25, slightly below its upper distal end 33. Yoke 31 is comprised of a pair of hooks 35, covered with cloth or rubber tubing 37, and diverging outward and slightly upward from a central pin 39, to which it is spot welded at Δ, and pivotally received in a bore 41 formed transverse to the main axis of second stem 25. Yoke 31 is provided to temporarily receive therein the top member of an instrument such as the tuning peg board 43 that sits atop the guitar neck 45. Yoke 31 is pivotally attached to second stem 25 to allow a slight bit of movement to the guitar that often occurs when a musician lifts one guitar from stand 1 while quickly replacing another guitar in the same stand. In this configuration, the body 47 of guitar 3 is maintained at the lowest point and above base 5.

Figure 10:
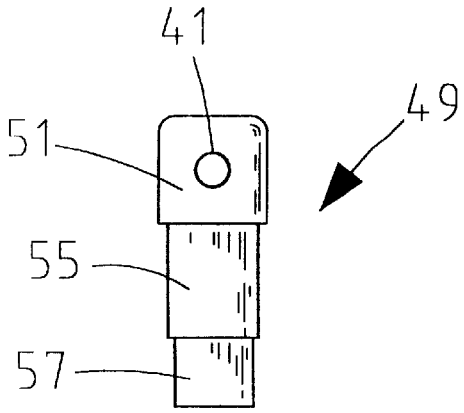
FIG. 10 is a side view of the plug that fits in the top of the stem and holds the yoke; and, FIG. 11 is a side view of the fitting that connects the two stem pieces together.
Figure 8:
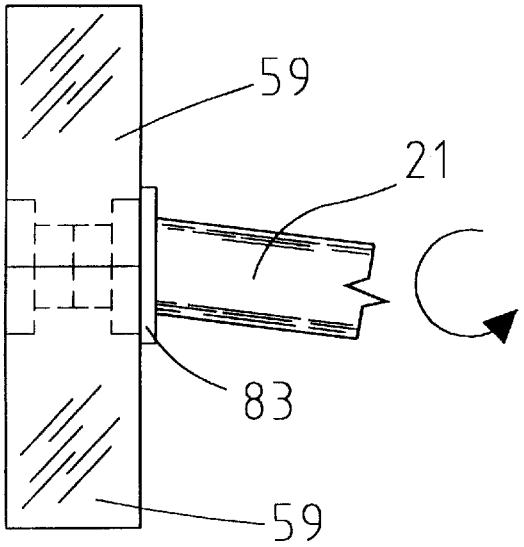

FIG. 10 shows a plug 49 for insertion into second stem upper distal end 33. Plug 49 comprises an outer portion 51, having bore 41 formed therein for receipt of center pin 39, a slightly smaller middle portion 55 and a further reduced lower portion 57, second middle portion 55 and lower portion 57 are arranged for insertion into like openings formed inward from distal end 33.

Figure 4:
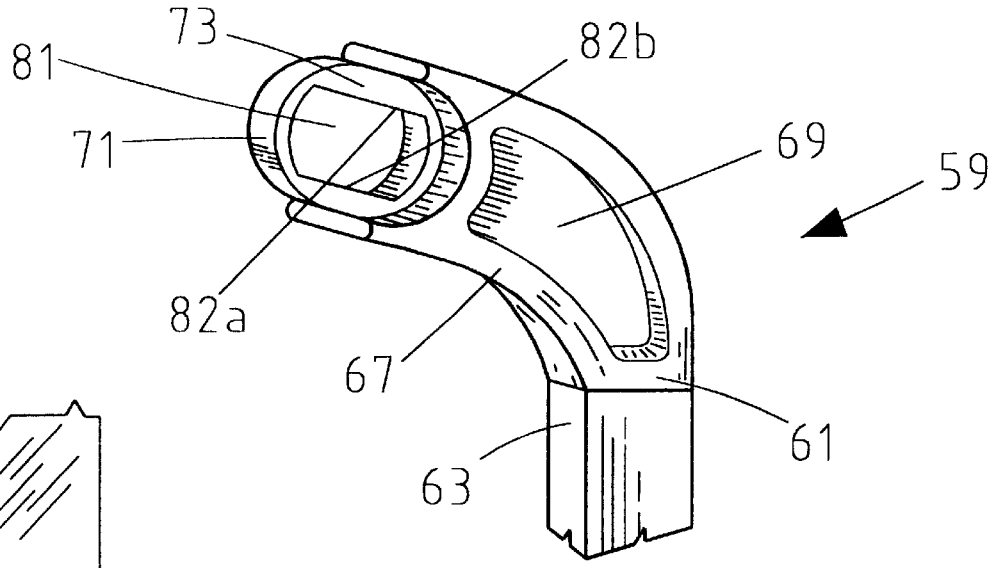
FIG. 4 is a perspective view of one of the connector elements of this invention.
Figure 5:
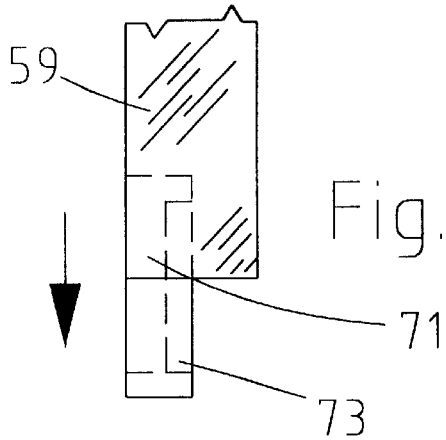
FIG. 5 is a side view of the connector elements shown in FIG. 4 before they are interconnected.
Figure 6:
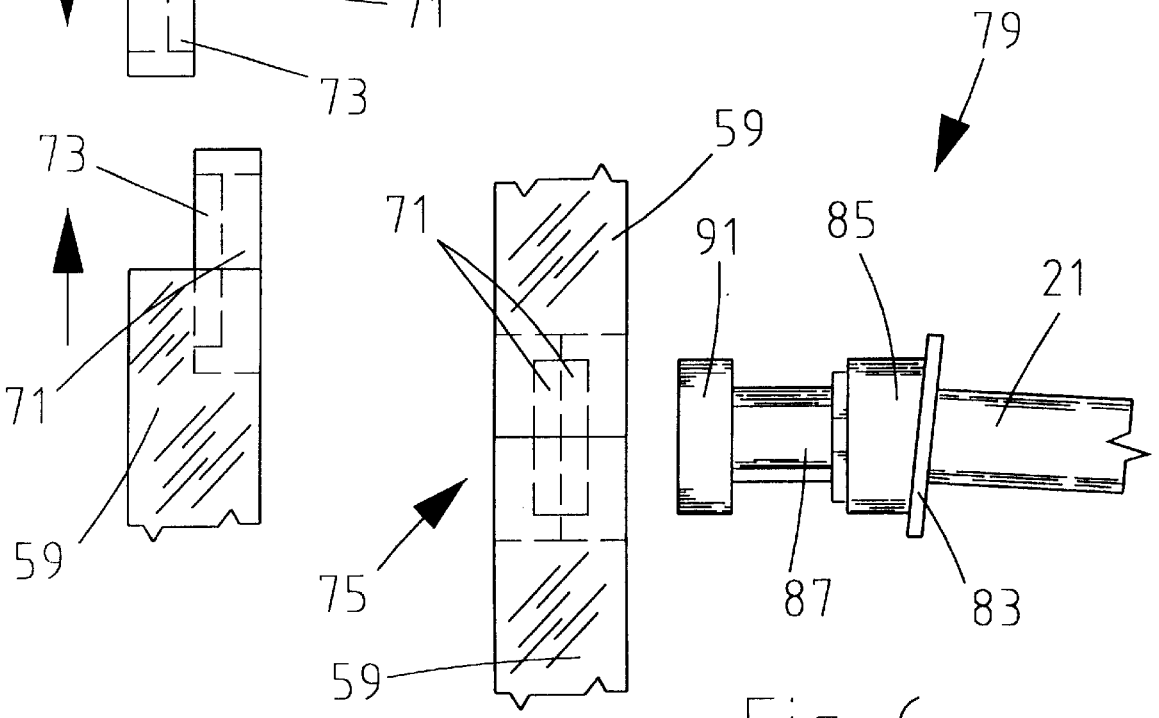
FIG. 6 is a side view of the connector elements shown in FIG. 5 after they are interconnected and the first stem is ready to be interconnected therewith.
Figure 7:
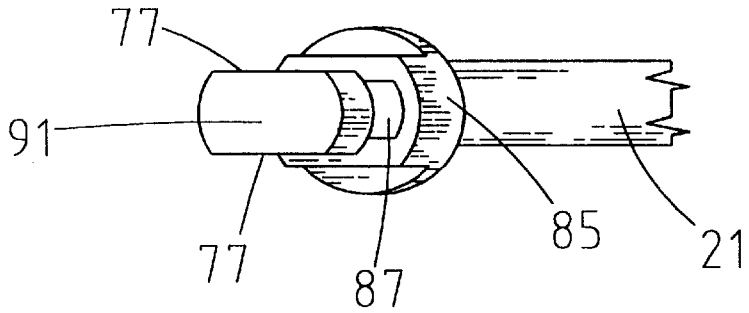
FIG. 7 is an isometric view of the end of the first stem for connection to the base; and, FIG. 8 is the same side view of the connector elements shown in FIG. 4 after they are interconnected and the first stem is interconnected therewith and twisted 90°.

First and second connector elements 59, each identical in construction, are provided and shown in FIG. 4 wherein each said element includes a first end 61 including a fitting for inserting into one end 63 of each leg 7 or 9 to form a fixed connection therebetween. A curved section 67 is next provided extending from first end 61 as shown in FIG. 4, and preferably includes a thinned section 69 to save weight in element 59 without a sacrifice in strength. A half-fitting 71 is provided at the end of each curved section 67 and includes an interior wall 73 that is adapted for mating engagement with another like interior wall 73 in the other half-fitting 71 on the other connector element 59 to form a fully assembled connectable fitting 75 as shown in FIG. 6. The interior walls 73 are offset to one side of each half-fitting 71 so that when half-fittings 71—71 are placed together in full assembly, both interior walls 73 come together and form a double-thick wall 71—71. This double-thick wall 71—71 completes the fully connectable fitting 75 between legs 7 and 9 and provides for further engagement with a lockable fitting 79 located at first stem end 21. Double thick wall 71—71 forms an aperture 81 therethrough that is asymmetrically configured so as to allow passage therethrough of a non-symmetrical shape. Specifically as shown in FIG. 4, aperture 81 includes two flats 82*a* and 82*b* set in opposed, parallel arrangement.

Lockable fitting 79 comprises a first element 83 for fixed connection to stem end 21 such as by a male connector (not shown) extending from first element 83 for mating receipt in a female connector inserted in stem end 21. First element 83 is of a size and shape as not to be passable through assembled half-fittings 71. A second element 85 extends outward from said first element 83 and also is of a size and shape as to not be able to pass completely through fully assembled half-fittings 79. A shaft 87 fixedly extends outward from said second element 85 for passing through said assembled half-fittings 71—71 and through said aperture 81 and beyond said assembled walls 73—73. A third element 91 extends outward from shaft 87, of a greater diameter than shaft 87 and of an asymmetric outline that can pass through aperture 81 and then be rotated into a locked position on the other side thereof. This rotation is usually accomplished by twisting first stem 19 about 90°. Upon twisting, stem 19 is held in fixed connection with interconnection 13 and second element 85 and third element 91 are fixed on both sides of assembled walls 75 in asymmetric relation thereto.

Third element 91 contains two, spaced-apart flats 77 that pass through aperture 93 to then be locked against separation after first stem 19 is twisted 90°. When said interconnected fitting 75 is further connected to first stem 19, base 5 remains totally planar and can rest flat on the supporting surface, be it a floor or a stage.

Figure 11:
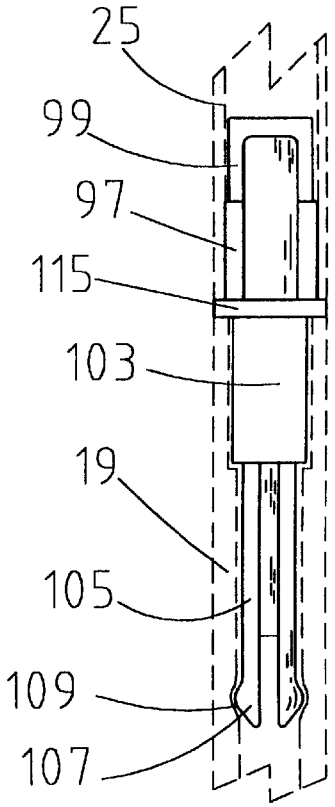

The junction between second stem 27 and connecting end 29 is accomplished by a fitting that, as shown in FIG. 11, comprises a first graduated, squared-offplug 97 with a similar, but smaller second squared-off plug 99 extending therefrom, both plugs arranged for insertion into the hollow end of second stem 25. The other end of fitting 95 comprises a first squared-off plug 103 that forms the base for an extended fork 105 having a pair of (male) bulbular ends 107 that fit into the female opening 109 in a second plug (not shown) inserted in first stem 19. A short spacer 115 maintains the ends of stem 19 and stem 25 in close connected arrangement.

Figure 9A:
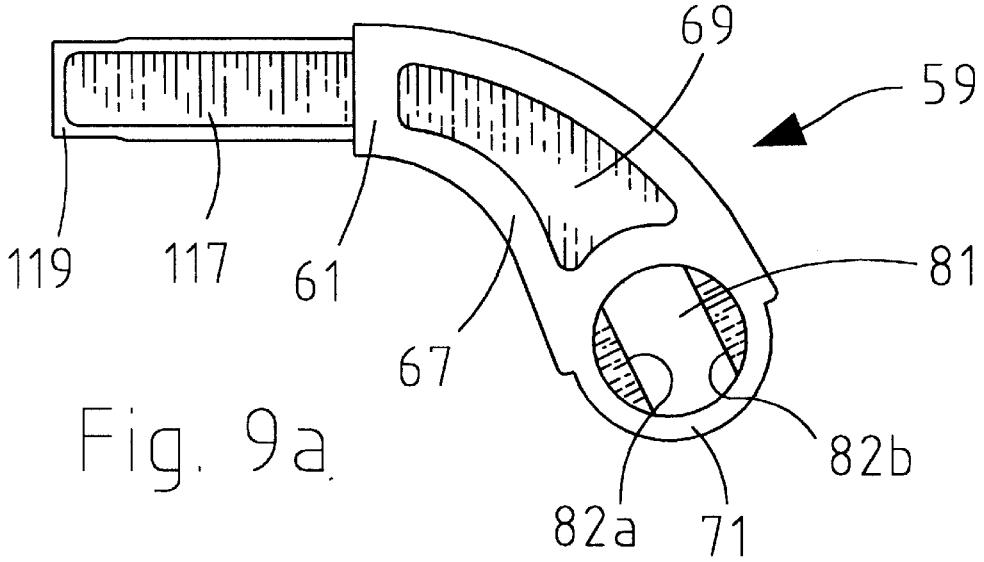
FIG. 9*a* is a side view of the plug for connecting the legs to the stem.
Figure 3A:
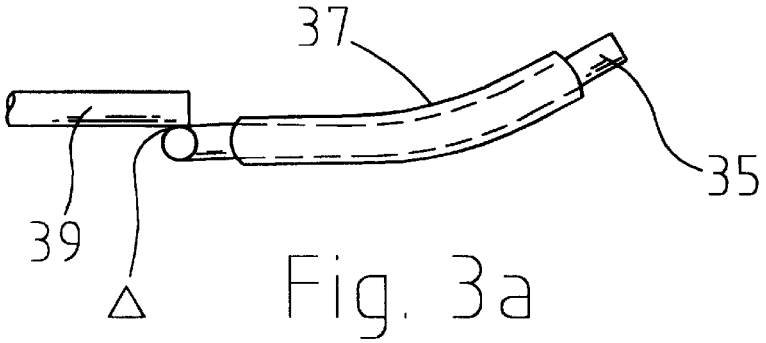
FIG. 3*a* is a side view of the yoke for suspending a musical instrument in this invention.
Figure 3B:
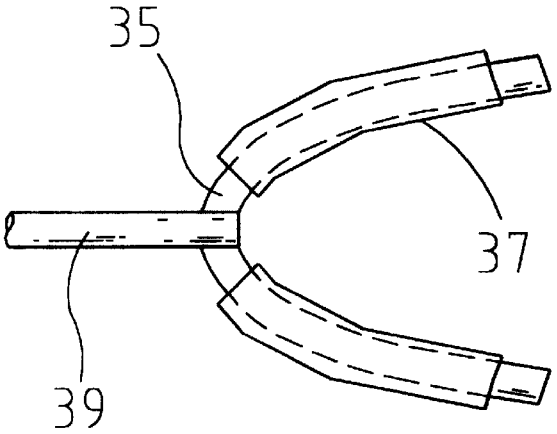
FIG. 3*b* is a top view of the embodiment shown in FIG. 3*a;*
Figure 9B:
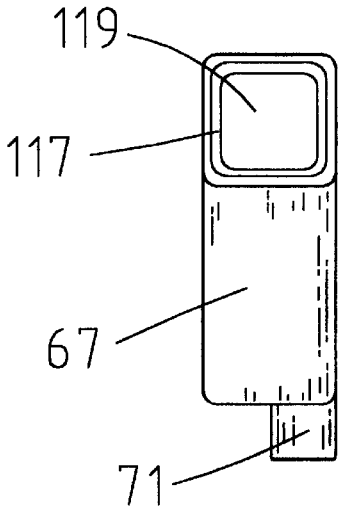
FIG. 9*b* is a front view of the plug shown in FIG. 9*a;*

Similarly, the junction between connector element 59 and leg 7 or 9 is shown in FIGS. 9*a* and 9*b* and shows a first squared plug 117 from which a second squared plug 119 extends, both first plug 117 and second plug 119 arranged to be inserted in one end of leg 7 or 9.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the cope of this invention.

What is claimed is:

1. A multiple-piece musical instrument stand comprising:

a) a base including first and second legs extending outward at an acute angle from interconnection therebetween;

b) a first stem of terminal length having one end for inter-fitting with said interconnection of said legs and extending upward therefrom at an acute angle to the plain of said base;

c) a second stem defined by a connecting end for connection to said distal end of said first stem and continuing upward at the same acute angle as said first stem;

d) an instrument yoke extending outward from said second stem member attached thereto to temporarily receive therein the head member of a stringed instrument so as to retain said instrument therein with the weight of said instrument hanging freely downward and above said base to support said instrument within said acute angle formed between said yoke and said base; and, e) first and second connector elements, each said element comprising:

i) a first end including a fitting for inserting into one end of each said leg to form a fixed connection therebetween;

ii) a curved section extending outward from said fitting to provide a portion of said acute angle formed between said interconnected legs;

iii) a second end attached to said curved section containing a half-fitting including at least one offset interior wall, said half-fitting for mating engagement with said other half-fitting to form a fully assembled inter-connectable fitting for engagement with said stem wherein said offset interior walls come together to form a double wall; and, iv) an asymmetrical aperture formed through said double wall for receipt therethrough of an asymmetric member for lockable assembly therewith.

2. The multiple-piece musical instrument stand of claim 1 wherein said assembled legs form a flat surface that lies in contact with the surface on which said stand is erected.

3. The multiple-piece musical instrument stand of claim 1 wherein said legs are formed of lightweight hollow tubing.

4. The multiple-piece musical instrument stand of claim 1 wherein said legs are formed of lightweight square hollow tubing.

5. The multiple-piece musical instrument stand of claim 1 wherein said legs extend straight outward from said interconnection therebetween.

6. The multiple-piece musical instrument stand of claim 1 further including a lockable fitting for interconnecting said stem to said base, said fitting comprising:

a) a first element for fixed connection to said one end of said stem;

b) a second element extending from said first element of a size and shape as to not be able to pass completely through said fully assembled half-fittings;

c) a shaft fixedly extending outward from said second element for passing through and beyond said partitions and completely through said second end of said connector element; and, d) a third element extending outward from said shaft, of a greater diameter than said shaft and of an asymmetrical shape for passing through said asymmetrical aperture and then being rotated with said fitting to move into locking position with said connector element and said walls.

7. The multiple-piece musical instrument stand of claim 1 wherein said interior walls are divided and formed in parallel, spaced apart pairs in each connector half-fitting, said pairs of walls arranged to be nestled together in the center portion of said connector.

8. The multiple-piece musical instrument stand of claim 1 wherein said instrument yoke is pivotally attached to said stem.

9. A multiple-piece stand comprising:

a) a base including first and second hollow legs extending outward at an acute angle from interconnection therebetween, said legs having at least one flat surface to rest fully on a planar surface;

b) a first short stem of terminal length having one end for inter-fitting with said interconnection of said legs and extending upward therefrom at an acute angle to the plain of said base;

c) a second short stem defined by a connecting end for removably connecting to said distal end of said first stem and continuing upward at the same acute angle as said first stem;

d) a yoke extending outward from said second stem member attached thereto to temporarily receive therein the top member of an instrument so as to retain said instrument therein with the weight of said instrument hanging freely downward, without further support, and above said base to support said instrument within said acute angle formed between said yoke and said base;

e) first and second connector elements, each said element comprising:

i) a first end including a fitting for inserting into one end of said leg to form a fixed connection therebetween;

ii) a curved section including a thin, weight-saving section extending outward from said fitting to provide a portion of said acute angle formed between said interconnected legs; and, iii) a second end attached to said curved section containing a half-fitting including at least one offset interior wall, said half-fitting arranged for mating engagement with said other half-fitting to form a further inter-connectable fitting for engagement with said stem;

iv) said offset interior walls coming together to form a double thick wall and forming an asymmetrical aperture therethrough.

10. The multiple-piece stand of claim 9 wherein said assembled legs form a flat surface that lies in contact with the surface on which said stand is erected.

11. The multiple-piece stand of claim 9 wherein said legs and said stems are formed of lightweight hollow tubing.

12. The multiple-piece stand of claim 9 wherein said legs and said stems are formed of lightweight square hollow tubing.

13. The multiple-piece stand of claim 9 wherein said legs extend straight outward from said interconnection therebetween.

14. The multiple-piece stand of claim 9 further including a lockable fitting for interconnecting said stem to said base, said fitting comprising:

a) a first element for fixed connection to said one end of said stem;

b) a second element extending from said first element of a size and shape as to not be able to pass completely through said second end of said connector element;

c) a shaft fixedly extending outward from said second element for passing beyond said partitions and completely through said second end of said connector element; and, d) a third element extending outward from said shaft, of a greater diameter than said shaft and of a symmetry allowing it to pass through said aperture and then, after rotating said fitting to move into locking position with said connector element and sandwiching said interior walls between said second element and said third element.

15. The multiple-piece stand of claim 14 wherein said interior walls are divided and formed in parallel, spaced apart pairs of short walls in each connector half-fitting, said pairs of walls arranged to be nestled together in the center portion of said connector.

16. The multiple-piece stand of claim 15 wherein said lockable fitting is arranged at an angle to the long axis of said stem to provide an acute angle when connected to said base.

17. The multiple-piece stand of claim 15 wherein said legs rest fully on a planar surface.

* * * * *